US009297168B2

(12) United States Patent
Kim

(10) Patent No.: US 9,297,168 B2
(45) Date of Patent: Mar. 29, 2016

(54) PANEL FOR WALL OF A SET BUILDING AND THEREOF CONSTRUCTION METHOD

(71) Applicant: Sung Gen Kim, Gyeonggi-do (KR)

(72) Inventor: Sung Gen Kim, Gyeonggi-do (KR)

( * ) Notice: Subject to any disclaimer, the term of this patent is extended or adjusted under 35 U.S.C. 154(b) by 240 days.

(21) Appl. No.: 13/810,598

(22) PCT Filed: Oct. 23, 2012

(86) PCT No.: PCT/KR2012/008693

§ 371 (c)(1),
(2) Date: Jan. 16, 2013

(87) PCT Pub. No.: WO2013/062277

PCT Pub. Date: May 2, 2013

(65) Prior Publication Data

US 2014/0305063 A1 Oct. 16, 2014

(30) Foreign Application Priority Data

Oct. 27, 2011 (KR) ..... 10-2011-0110273

(51) Int. Cl.
*E04B 2/30* (2006.01)
*E04F 13/08* (2006.01)

(52) U.S. Cl.
CPC ..... *E04F 13/0866* (2013.01); *E04F 13/0803* (2013.01); *E04F 13/0805* (2013.01)

(58) Field of Classification Search
CPC ..... E04B 2001/2481; E04B 5/40; E04F 15/02452; E04F 15/02044; E04F 15/02038
USPC ..... 52/489.1, 506.1, 650.3, 475.1, 506.05, 52/506.06, 478
See application file for complete search history.

(56) References Cited

U.S. PATENT DOCUMENTS

| | | | | | |
|---|---|---|---|---|---|
| 3,043,407 | A * | 7/1962 | Marryatt | 52/588.1 |
| 3,110,371 | A * | 11/1963 | De Ridder | 52/588.1 |
| 3,813,839 | A * | 6/1974 | Simpson et al. | 52/506.1 |
| 4,126,006 | A * | 11/1978 | Lewis | 405/220 |
| 4,522,007 | A * | 6/1985 | Oehlert | 52/506.1 |
| 5,170,605 | A * | 12/1992 | Huddle | 52/588.1 |
| 5,513,472 | A * | 5/1996 | Olsen et al. | 52/177 |
| 5,647,184 | A * | 7/1997 | Davis | 52/592.1 |
| 5,768,850 | A * | 6/1998 | Chen | 52/747.1 |
| 5,816,010 | A * | 10/1998 | Conn | 52/588.1 |
| 6,226,950 | B1 * | 5/2001 | Davis | 52/592.1 |
| 6,584,748 | B2 * | 7/2003 | Bresnahan | 52/650.3 |
| 7,415,801 | B2 * | 8/2008 | Zeng et al. | 52/177 |
| 7,997,033 | B2 * | 8/2011 | Tumlinson et al. | 52/38 |
| 2001/0045073 | A1 * | 11/2001 | Bresnahan | 52/506.06 |
| 2003/0009973 | A1 * | 1/2003 | Lee | 52/589.1 |

* cited by examiner

*Primary Examiner* — Brian Glessner
*Assistant Examiner* — Paola Agudelo
(74) *Attorney, Agent, or Firm* — John K. Park; Park Law Firm

(57) ABSTRACT

The present invention provides a panel assembly for a wall of a prefabricated building and a method of constructing the panel assembly. In the present invention, the simple assembly and construction operation renders it possible to enhance the workability in a construction site, thus reducing the cost of labor. Further, the panel assembly is simple and elegant, thus satisfying the aesthetic sense of users. In addition, the panel assembly is scientifically designed so that it can be precisely constructed. The functional structure of the panel assembly can maximize the waterproofing effect while minimizing the generation of noise. Furthermore, because the panel assembly is made of aluminum material, the reduced weight thereof facilitates the processing operation and transportation. Also, the panel assembly reliably resists ultraviolet rays and rain-water.

8 Claims, 15 Drawing Sheets

PANEL FOR WALL OF A SET BUILDING AND THEREOF CONSTRUCTION METHOD

BACKGROUND OF THE INVENTION

1. Field of the Invention

The present invention relates generally to panel assemblies for walls of prefabricated buildings and methods of constructing the same and, more particularly, to a panel assembly for a wall of an prefabricated building which is configured such that the assembly and construction thereof are simple, and which not only can provide the beauty of brevity and elegant aesthetic sense but can also provide the functionality of being waterproof and soundproof, and a method of constructing the panel assembly.

2. Description of the Related Art

Generally, a conventional method of constructing a wall of a building includes applying a predetermined thickness of mortar on the bottom, placing bricks or blocks on the applied mortar, applying mortar to upper ends and side surface of the bricks or blocks, and repeatedly laying bricks or blocks and applying the motor to them.

However, this conventional method uses mortar to bond the bricks or blocks to each other. The use of mortar requires additional working labor and time needed to form mortar. Furthermore, cement powder and mortar fragments fall onto the bottom, thus not only making the construction site unclean but also damaging the health of workers. Moreover, additional labor is required to clean up the cement powder or mortar fragments, thereby increasing the labor costs, and making the construction operation difficult.

In addition, because the bricks are comparatively small, it takes a lot of time to form a wall using bricks, thus increasing the construction period.

To overcome the problems of the above-mentioned conventional wall construction method, a method of constructing a wall using wall assembly panels was proposed. The conventional wall assembly panel for constructing a wall is a sandwich panel in which metal plates are bonded to outer surfaces of a medial member made of adiabatic and soundproof material such as Styrofoam or urethane. The wall assembly panel has on opposite ends thereof female-male connection structures which are used to connect the wall assembly panels to each other.

Such conventional wall assembly panels are constructed in such a way that they are attached, by fastening members such as bolts, screws or nails, to both surfaces of wall frames that are installed longitudinally and laterally between the columns of the building. Therefore, a large numbers of panels, wall frames and fastening members are required. Further, a complex construction process requires a lot of labor and construction time.

Particularly, a hollow space is defined between inner and outer panels by the thickness of the wall frames when the panels are constructed. This hollow space causes resonance in the interior of the building. Also, insects and mice proliferate in the hollow space, thus creating sanitation problems.

SUMMARY OF THE INVENTION

Accordingly, the present invention has been made keeping in mind the above problems occurring in the prior art, and a first object of the present invention is to provide a panel assembly for a wall of a prefabricated building which facilitates the construction of the wall.

A second object of the present invention is to provide a panel assembly for a wall of a prefabricated building which can arouse the aesthetic sense.

A third object of the present invention is to provide a panel assembly for a wall of a prefabricated building which can provide waterproof effect and minimize generation of noise.

In order to accomplish the above object, the present invention provides a panel assembly for a wall of a prefabricated building, including: a panel fastening frame having a base plate, side support protrusions provided on left and right side edges of an upper surface of the base plate, with a groove formed in each of the side support protrusions, a pair of support ribs provided on the base plate between the side support protrusions and oriented parallel to each other in a longitudinal direction such that the support ribs face each other and a width therebetween is constant, each of the support ribs having a height equal to a height of the side support protrusions, with a removal prevention stopper provided on an inner surface of each of the support ribs, locking protrusions respectively provided on left and right side edges of a lower surface of the base plate, and a plurality of leg pieces provided on the lower surface of the base plate between the locking protrusions, the leg pieces having a same height, wherein the panel fastening frame is fastened to the wall by fastening members tightened into the wall after passing through depression portions formed between the side support protrusions and the support ribs; a start panel having a base plate, a locking protrusion provided on an upper surface of one side edge of the base plate, a support plate provided at a right angle on a central portion of the upper surface of the base plate, and a male coupling piece integrally provided on the support plate and oriented upward and toward the locking protrusion; a baseboard panel having an uneven plate formed of rectangular protruding portions and rectangular depressed portions which alternate with each other, a coupling panel part integrally provided on a first edge of the uneven plate, the coupling panel part having a shape equal to a shape of the start panel, and a female coupling piece provided on a second edge of the uneven plate so that the female coupling piece engages with the male coupling piece; and a wall assembly panel having a planar body provided with a first leg piece and a second leg piece under a lower surface thereof, a connection piece provided on a first edge of the planar body, a coupling panel part integrally provided on the connection piece, the coupling panel part having a shape equal to the shape of the start panel, and a female coupling piece integrally provided on a second edge of the planar body.

In a panel assembly for a wall of a prefabricated building and a method of constructing the panel assembly according to the present invention, simple assembly and construction operation can render it possible to enhance the workability on a construction site, thus reducing the labor costs. Further, the construction period can be reduced, thus reducing the cost of the construction.

In addition, the present invention is simple and elegant, thus satisfying the aesthetic sense of users. Moreover, the present invention is scientifically designed so that it can be precisely constructed. The functional structure of the present invention can maximize the waterproof effect while minimizing the generation of noise.

Moreover, because the present invention uses aluminum material, the weight of the panel assembly is reduced, thus facilitating the processing operation and transportation. Also, the panel assembly reliably resists ultraviolet rays or rainwater.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a preferred embodiment of the present invention will be described in detail with reference to the attached drawings.

Figure 1A:
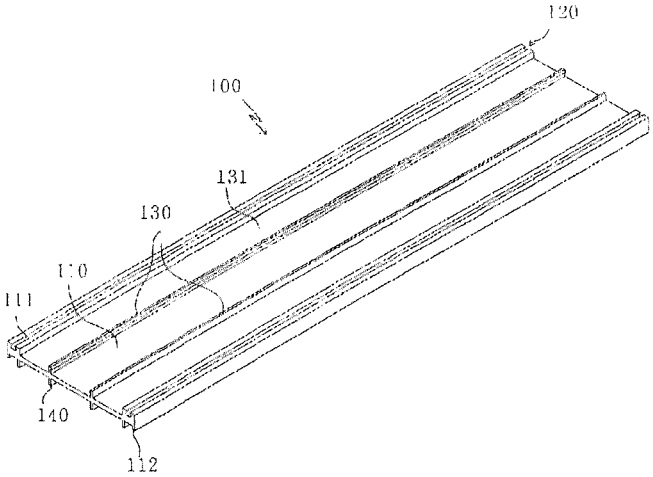
FIG. 1A is a perspective view illustrating a preferred embodiment of a panel fastening frame of a panel assembly for a wall of a prefabricated building according to the present invention.
Figure 1B:
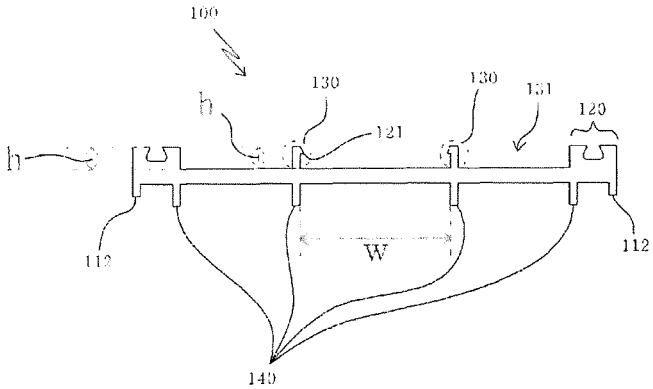
FIG. 1B is a sectional view illustrating the panel fastening frame of FIG. 1A.

FIG. 1A is a perspective view illustrating a preferred embodiment of a panel fastening frame 100 of a panel assembly for a wall of a prefabricated building according to the present invention. FIG. 1B is a sectional view illustrating the panel fastening frame 100 of the panel assembly according to the present invention. Referring to FIGS. 1A and 1B, the panel fastening frame 100 according to the present invention includes a base plate 110. Side support protrusions 120 are provided on left and right side edges of an upper surface of the base plate 110. A groove 111 is formed in an upper surface of each side support protrusion 120. Two support ribs 130 which have the same height h as that of the side support protrusions 120 are provided on the base plate 110 between the side support protrusions 120. The support ribs 130 are provided parallel to each other in the longitudinal direction such that they face each other and a width w therebetween is constant. A removal prevention stopper 121 is provided on an inner surface of each support rib 130.

Furthermore, locking protrusions 112 are respectively provided on left and right side edges of a lower surface of the base plate 110. A plurality of leg pieces 140 which have the same height are provided on the lower surface of the base plate 110 between the locking protrusions 112.

The panel fastening frame 100 is fastened to a wall 10 by fastening members 20 tightened into the wall 10 after they have passed through depression portions 131 between the side support protrusions 120 and the support ribs 130. The panel fastening frame 100 functions as a basic frame which is used to fasten a start panel 200, a baseboard panel 300 and a wall assembly panel 400 to the wall 10.

Figure 2A:
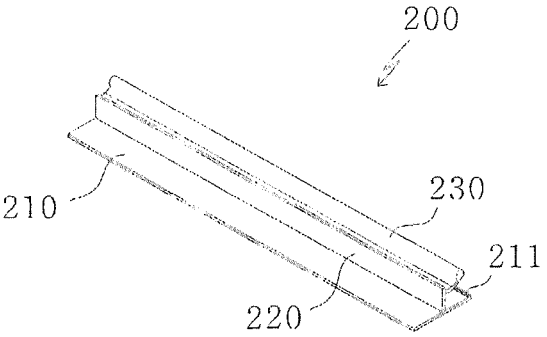
FIG. 2A is a perspective view illustrating a preferred embodiment of a start panel of the panel assembly according to the present invention.
Figure 2B:
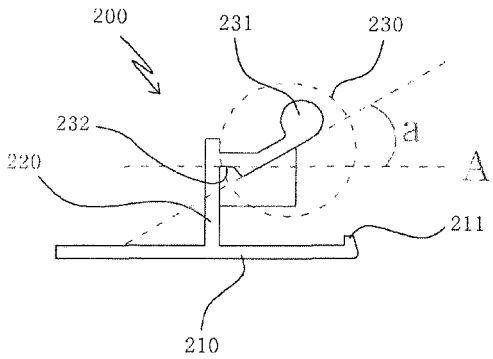
FIG. 2B is a sectional view of the start panel of FIG. 2A.

FIG. 2A is a perspective view illustrating an embodiment of the start panel 200 of the panel assembly according to the present invention. FIG. 2B is a sectional view of the start panel 200 of FIG. 2A. Referring to FIGS. 2A and 2B, the start panel 200 according to the present invention includes a base plate 210. A locking protrusion 211 is provided on an upper surface of one side edge of the base plate 210. A support plate 220 is provided at a right angle on a central portion of the upper surface of the base plate 210. A male coupling piece 230 is integrally provided on the support plate 220 and oriented upward and toward the locking protrusion 211. A coupling end 231 having a circular cross-section is provided on a first edge of the male coupling piece 230. A coupling depression 232 is formed in a lower surface of a second edge of the male coupling piece 230 that is connected to the support plate 220.

Preferably, the male coupling piece 230 is oriented upward at an angle a of 30° relative to a line A that is perpendicular to the support plate 220.

In this embodiment, although the angle a has been illustrated as being set to 30° to facilitate the coupling of a female coupling piece to the male coupling piece, the angle at which the male coupling piece is oriented is not limited to 30°, so that, in other words, the angle of the orientation of the male coupling piece can be adjusted depending on conditions of the installation of the start panel 200.

Figure 3A:
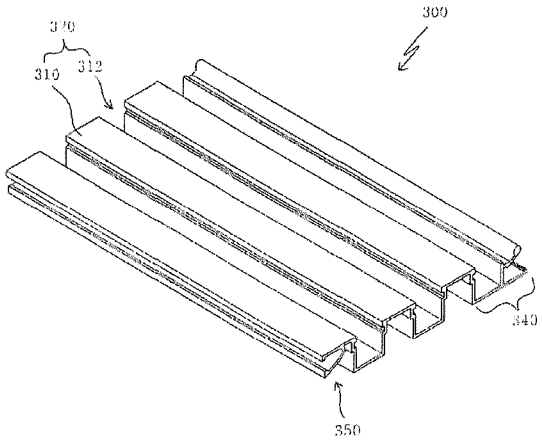
FIG. 3A is a perspective view illustrating a preferred embodiment of a baseboard panel of the panel assembly according to the present invention.
Figure 3B:
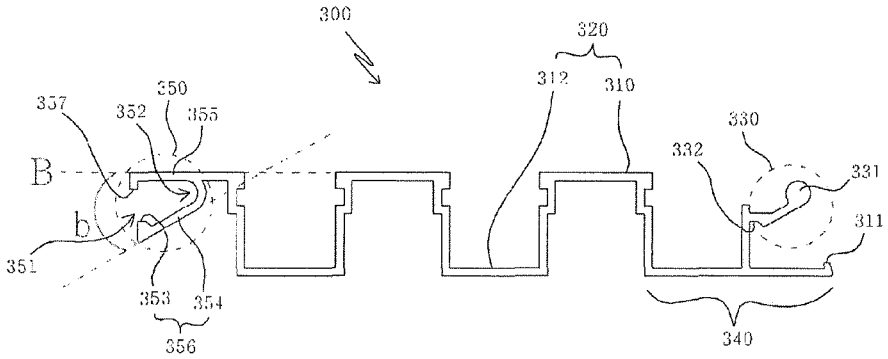
FIG. 3B is a sectional view of the baseboard panel of FIG. 3A.

FIG. 3A is a perspective view illustrating an embodiment of a baseboard panel 300 of the panel assembly according to the present invention. FIG. 3B is a sectional view of the baseboard panel 300 of FIG. 3A. Referring to FIGS. 3A and 3B, the baseboard panel 300 according to the present invention has an uneven plate 320 which includes rectangular protruding portions 310 and rectangular depressed portions 312 which alternate with each other. A coupling panel part 340 which has the same shape as that of the start panel 200 is integrally provided on a first edge of the uneven plate 320. A female coupling piece 350 which engages with the male coupling piece 230 is provided on a second edge of the uneven plate 320.

The female coupling piece 350 includes a coupling plate 355 and a coupling part 356 and has a " " shape. That is, an opening 351 is formed in a first side of the female coupling piece 350, and an arc-shaped seating part 352 is formed in an inner surface of a second side of the female coupling piece 350 so that the coupling end 231 of the male coupling piece 230 is inserted into the female coupling piece 350 through the opening 351 and seated onto the seating part 352.

A first edge of the coupling plate 355 is coupled to the uneven plate 320 in such a way that the coupling plate 355 is level with upper surfaces of the protruding portions 310. A shape protrusion 357 is provided on a second edge of the coupling plate 355 so that when the female coupling piece 350 is coupled to the male coupling piece 230, the shape protrusion 357 faces the edge of the support plate 220 to form a rectangular shape.

The coupling part 356 includes a connection piece 354 and a locking protrusion 353. The connection piece 354 is oriented downward at 60° relative to an extension line B extending from the coupling plate 355 to correspond to the male coupling piece 230 that is oriented upward at 30°relative to the line A, so that the male coupling piece 230 can be easily inserted at 45° into the female coupling piece 350, thus facilitating the coupling of the female coupling piece 350 to the male coupling piece 230. A locking protrusion 353 is provided on an edge of the connection piece 354. The shape of the locking protrusion 353 corresponds to that of the coupling depression 232 so that the locking protrusion 353 can engage with the coupling depression 232 when the female coupling piece 350 is coupled to the male coupling piece 230.

Figure 7:
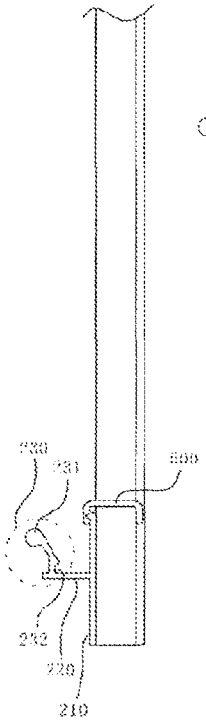
FIG. 7 is of sectional views illustrating an embodiment of a process of fitting a female coupling piece over a male coupling piece according to the panel assembly of the present invention.
Figure 7A:
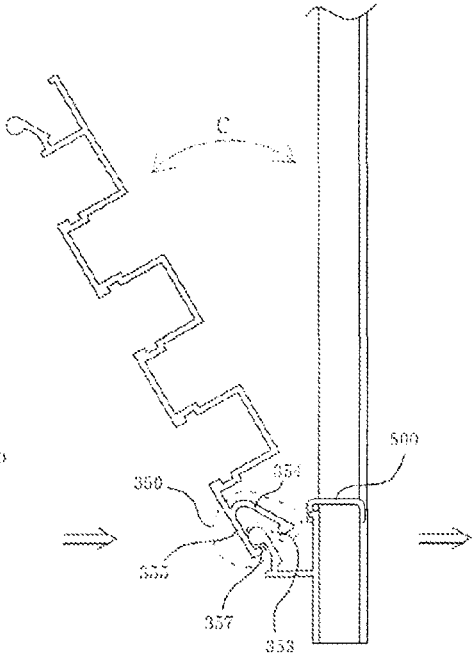
Figure 7B:
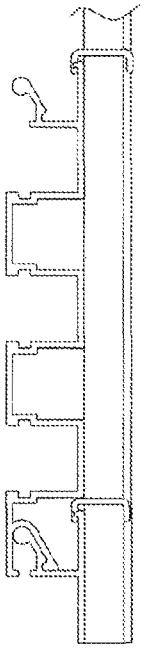

The coupling of the female coupling piece 350 to the male coupling piece 230 will be explained in detail. FIG. 7 is of sectional views illustrating a process of coupling the female coupling piece to the male coupling piece of the panel assembly according to the present invention.

Referring to FIG. 7, a first fastening clip 500 is locked to the locking protrusion 211 of the start panel 200 and fitted over the panel fastening frame 100 so that the start panel 200 is fastened to the panel fastening frame 100. Thereafter, the female coupling piece 350 of the baseboard panel 300 is fitted over the male coupling piece 230 of the start panel 200 at an angle c of 45° so that the coupling end 231 of the male coupling piece 230 is seated onto the seating part 352 of the female coupling piece 350, and the locking protrusion 353 of the female coupling piece 350 engages with the coupling depression 232 of the male coupling piece 230. Subsequently, another first fastening clip 500 is locked to the locking protrusion 311 of the baseboard panel 300 and fitted over the panel fastening frame 100 so that the baseboard panel 300 is fastened to the baseboard panel 300.

Figure 4A:
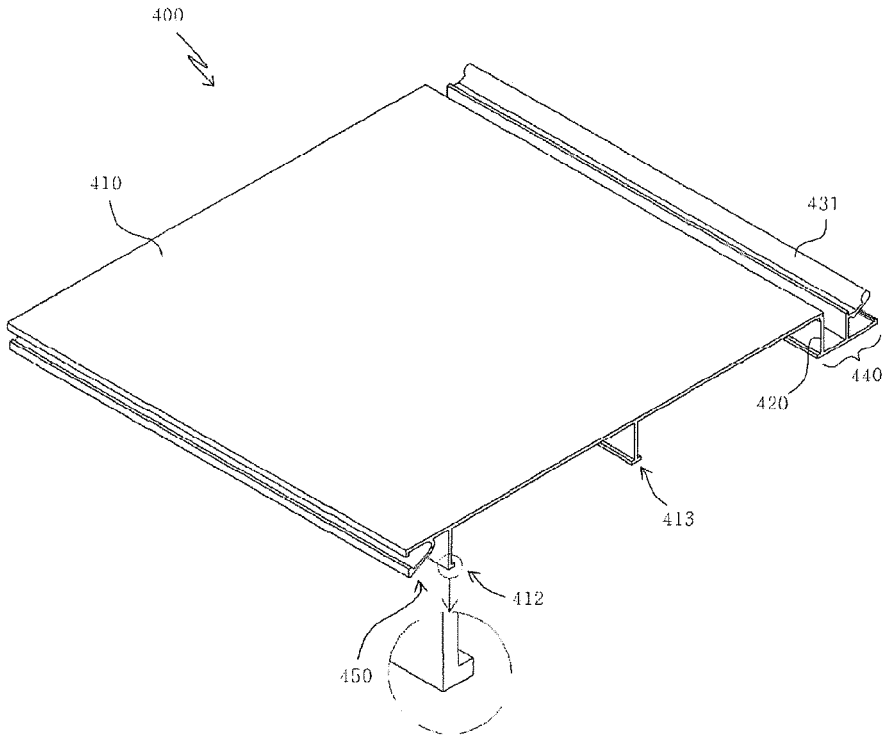
FIG. 4A is a perspective view illustrating a preferred embodiment of a wall assembly panel of the panel assembly according to the present invention.
Figure 4B:
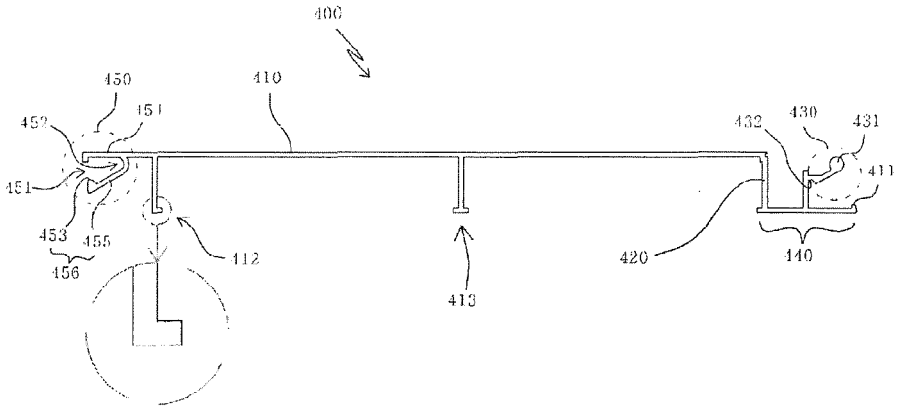
FIG. 4B is a sectional view of the wall assembly panel of FIG. 4A.

FIG. 4A is a perspective view illustrating an embodiment of the wall assembly panel 400 of the panel assembly according to the present invention. FIG. 4B is a sectional view of the wall assembly panel 400 of FIG. 4A. Referring to FIGS. 4A and 4B, the wall assembly panel 400 according to the present invention is an element which is coupled to the baseboard panel 300. The wall assembly panel 400 includes a planar body 410 which is provided with a first leg piece 412 and a second leg piece 413 under a lower surface thereof. A connection piece 420 is provided on a first edge of the planar body 410. A coupling panel part 440 which has the same shape as that of the start panel 200 is integrally provided on the connection piece 420. A female coupling piece 450 is integrally provided on a second edge of the planar body 410.

Figure 4C:
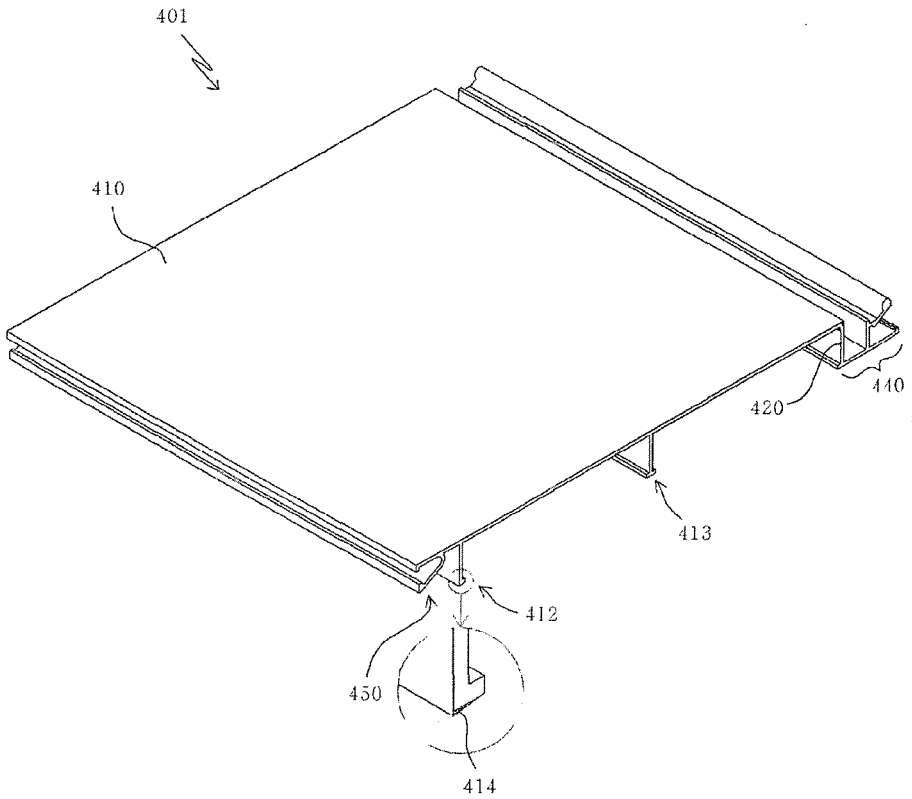
FIG. 4C is a perspective view illustrating another embodiment of a wall assembly panel of the panel assembly according to the present invention.
Figure 4D:
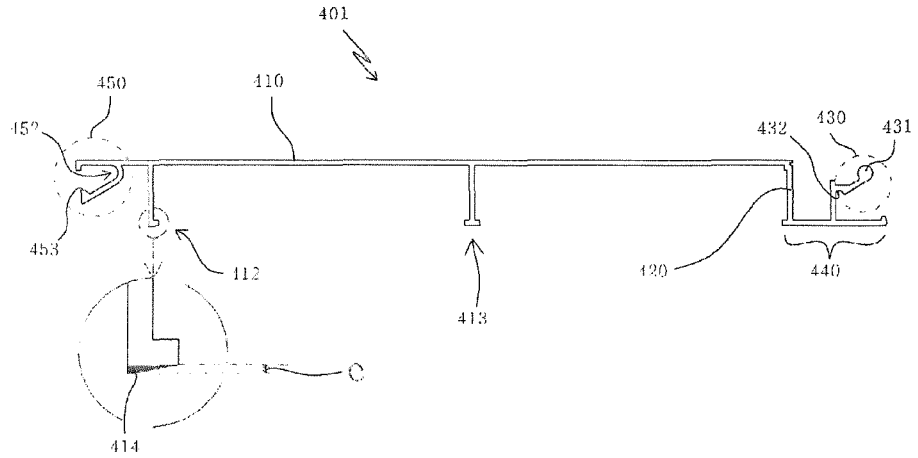
FIG. 4D is a sectional view of the wall assembly panel of FIG. 4C.

FIG. 4C is a perspective view illustrating a wall assembly panel 401 of the panel assembly according to another embodiment the present invention. FIG. 4D is a sectional view of the wall assembly panel 401 of FIG. 4C. Referring to FIGS. 4C and 4D, the wall assembly panel 401 according to this embodiment of the present invention further includes a triangular support piece 414 which is provided on an edge of the first leg piece 412 of the wall assembly panel 400. A height e of the triangular support piece 414 is approximately 0.5 mm.

The thickness of the wall assembly panel 400, 401 of the present invention is about 2 mm, and the material thereof is aluminum so that it can be bent by external force F. Therefore, when the wall assembly panel 401 is fastened to the panel fastening frame 100, the wall assembly panel 401 is bent from the panel fastening frame 100 into a bow shape by the triangular support piece 414 provided on the wall assembly panel 401.

Figures 4E, 4F, 4G, 4H:
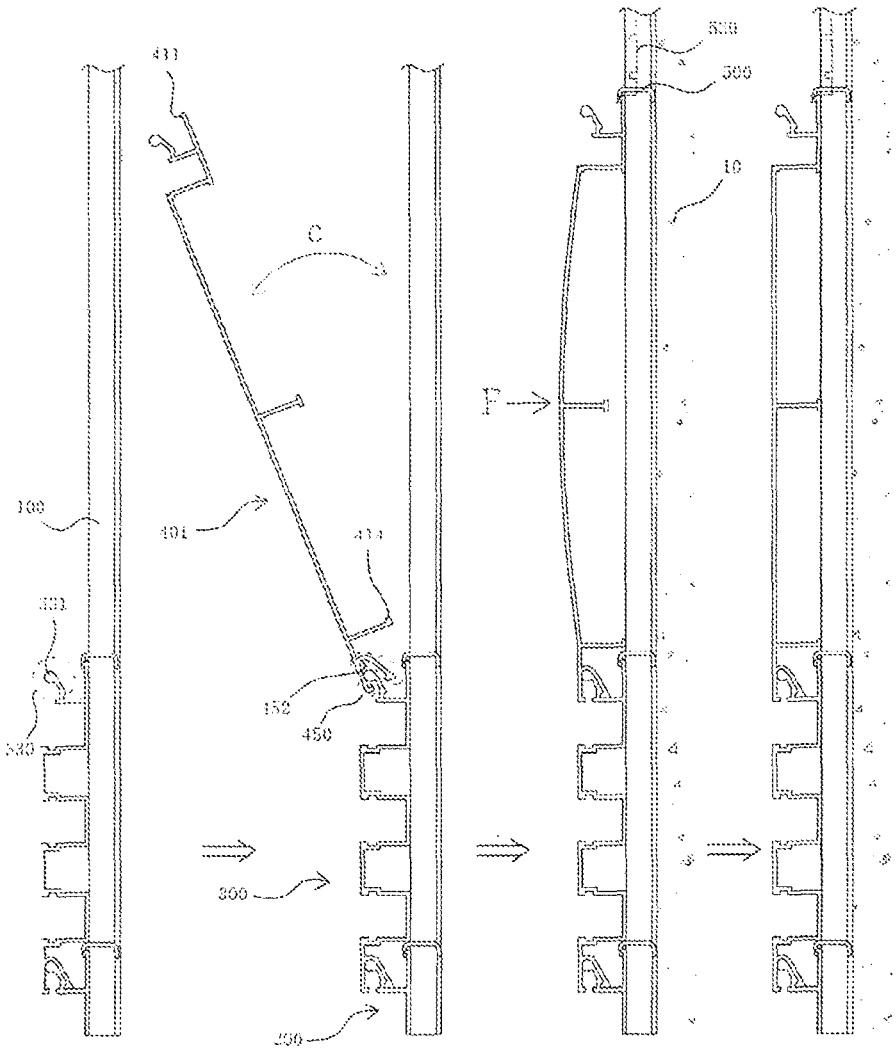
FIG. 4E is of sectional views illustrating a process of fastening the wall assembly panel of FIG. 4C to the panel fastening frame.

FIG. 4E is of sectional views illustrating a process of fastening the wall assembly panel 401 of FIG. 4C to the panel fastening frame 100. Referring to FIGS. 4C through 4E, the female coupling piece 450 of the wall assembly panel 401 is fitted over the male coupling piece 330 of the baseboard panel 300 at an angle c of 45° so that the coupling end 331 of the male coupling piece 330 is seated onto the seating part 452 of the female coupling piece 450, and the locking protrusion 453 of the female coupling piece 450 engages with the coupling depression 332 of the male coupling piece 330. Thereafter, the first fastening clip 500 is locked to the locking protrusion 411 of the wall assembly panel 401 and fitted over the panel fastening frame 100.

Subsequently, a second fastening clip 530 is fitted between the support ribs 130 of the panel fastening frame 100. The wall assembly panel 401 is fastened to the panel fastening frame 100 by tightening a fastening member 20 into a through hole 533 formed in the second fastening clip 530.

Thereafter, the wall assembly panel 401 that has been bent into a bow shape from the panel fastening frame 100 by the triangular support pieces 414 provided on the wall assembly panel 401 is pushed by external force F toward the wall 10 so that the wall assembly panel 401 makes close contact with the wall 10.

In this way, the wall assembly panel 401 that has been bent into a bow shape is brought into close contact with the wall 401. Here, the second leg piece 413 and the support piece 414 of the first leg piece 412 are brought into close contact with the wall 10, thus increasing frictional force between the wall assembly panel 401 and the wall 10, thereby minimizing the extent to which the wall assembly panel 401 slides down due to the force of gravity.

Figure 5A:
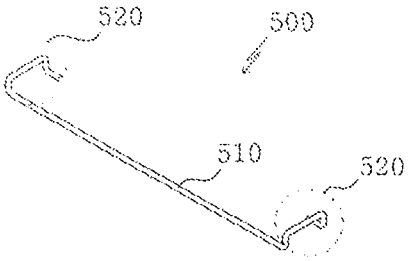
FIG. 5A is a perspective view illustrating an embodiment of a first fastening clip of the panel assembly according to the present invention.

FIG. 5A is a perspective view illustrating an embodiment of the first fastening clip 500 of the panel assembly according to the present invention. Referring to FIG. 5A, the first fastening clip 500 according to the present invention includes a fastening rod 510 which is locked to the locking protrusion 211, 311, 411, and hooks 520 which are provided on respective opposite ends of the fastening rod 510 and are locked to the corresponding locking protrusions 112 of the panel fastening frame 100.

The first fastening clip can substitute for fastening members 20. Unlike the fastening members 20 which cause damage to the panel, the first fastening clip can fasten the panel to the panel fastening frame 100 without causing damage to the panel and can facilitate the fastening operation, thus enhancing the workability.

Figure 5B:
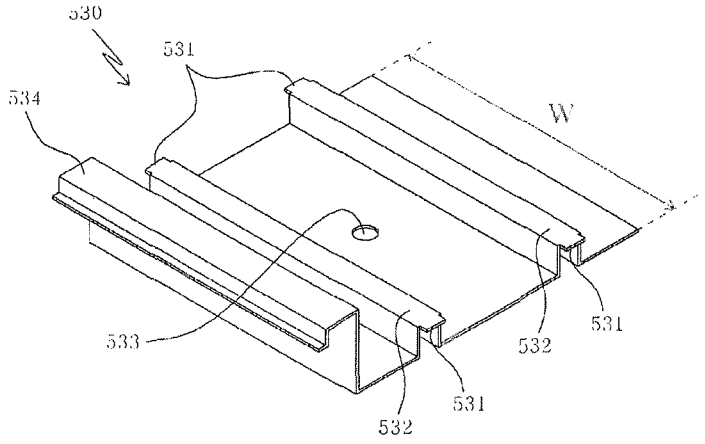
FIG. 5B is a perspective view illustrating an embodiment of a second fastening clip of the panel assembly according to the present invention.

FIG. 5B is a perspective view illustrating an embodiment of the second fastening clip 530 of the panel assembly according to the present invention. Referring to FIG. 5B, the second fastening clip 530 according to the present invention includes a pair of coupling parts 532. Each coupling part 532 has a length equal to the width w between the support ribs 130 of the panel fastening frame 100 so that the second fastening clip 530 can be fitted between the support ribs 130 of the panel fastening frame 100. Wing pieces 531 are provided on respective opposite ends of the coupling part 532. Thus, when the second fastening clip 530 is coupled to the panel fastening frame 100, the wing pieces 531 are locked to the removable prevention stoppers 121 of the support ribs 130, thus preventing the second fastening clip 530 from being removed from the panel fastening frame 100. The through hole 533 is formed in a central portion of the second fastening clip 530. Thus, the fastening member 20 is tightened into the panel fastening frame 100 by passing it through the through hole 533 in order to fasten the second fastening clip 530 to the panel fastening frame 100. A catch part 534 is provided on one end of the second fastening clip 530 so that the locking protrusion 211 and the fastening rod 510 of the first fastening clip 500 are locked to the catch part 534.

Therefore, the second fastening clip 530 makes it possible to more reliably fasten the wall assembly panel 400 to the panel fastening frame 100. The second fastening clip 530 effectively withstands the weight of another wall assembly panel 400 which is successively coupled to the wall assembly panel 400.

Figure 6A:
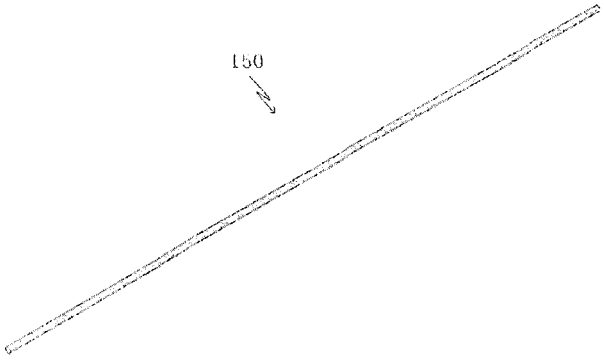
FIG. 6A is a perspective view illustrating a packing used in the panel fastening frame of the panel assembly according to the present invention.
Figure 6B:
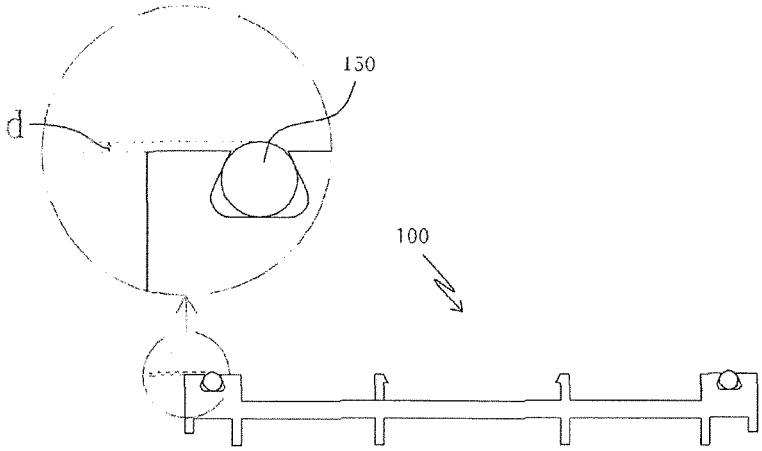
FIG. 6B is a sectional view showing the packing installed in the panel fastening frame of the panel assembly according to the present invention.

FIG. 6A is a perspective view illustrating a packing 150 used in the panel fastening frame of the panel assembly according to the present invention. FIG. 6B is a sectional view showing the packing 150 installed in the panel fastening frame of the panel assembly according to the present invention. Referring to FIGS. 6A and 6B, the packing 150 according to the present invention is made of urethane. The packing 150 is disposed in the groove 111 of the panel fastening frame 100 to absorb external impact applied to the panels fastened to the panel fastening frame 100 and reduce noise generated by contact between the panel fastening frame 100 and the panels.

The diameter of the packing 150 is preferably set such that when the packing 150 is disposed in the groove 111 of the panel fastening frame 100, it protrudes to a height d of about 0.3 mm from the upper surface of the side support protrusion 120.

Figure 8:
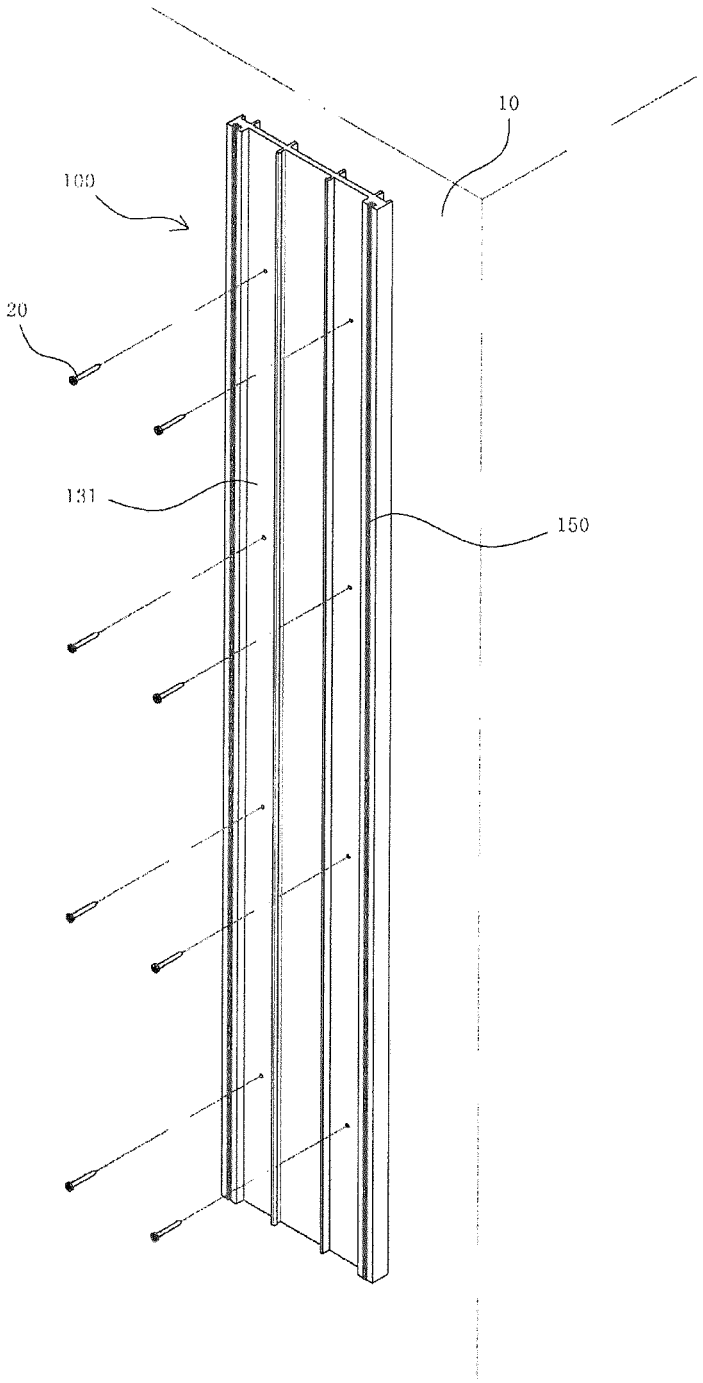
FIG. 8 is a perspective view illustrating an embodiment of a method of fastening the panel fastening frame of the panel assembly to a wall using fastening members according to the present invention.

FIG. 8 is a perspective view illustrating an embodiment of a method of fastening the panel fastening frame 100 of the panel assembly to the wall 10 using the fastening members 20 according to the present invention. Referring to FIG. 8, the panel fastening frame 100 is disposed on the wall 10. The fastening members 20 are tightened into the corresponding depression portions 131 of the panel fastening frame 100, thus fastening the panel fastening frame 100 to the wall 10. The packings 150 are fitted into the corresponding grooves 111 of the panel fastening frame 100.

Figure 9:
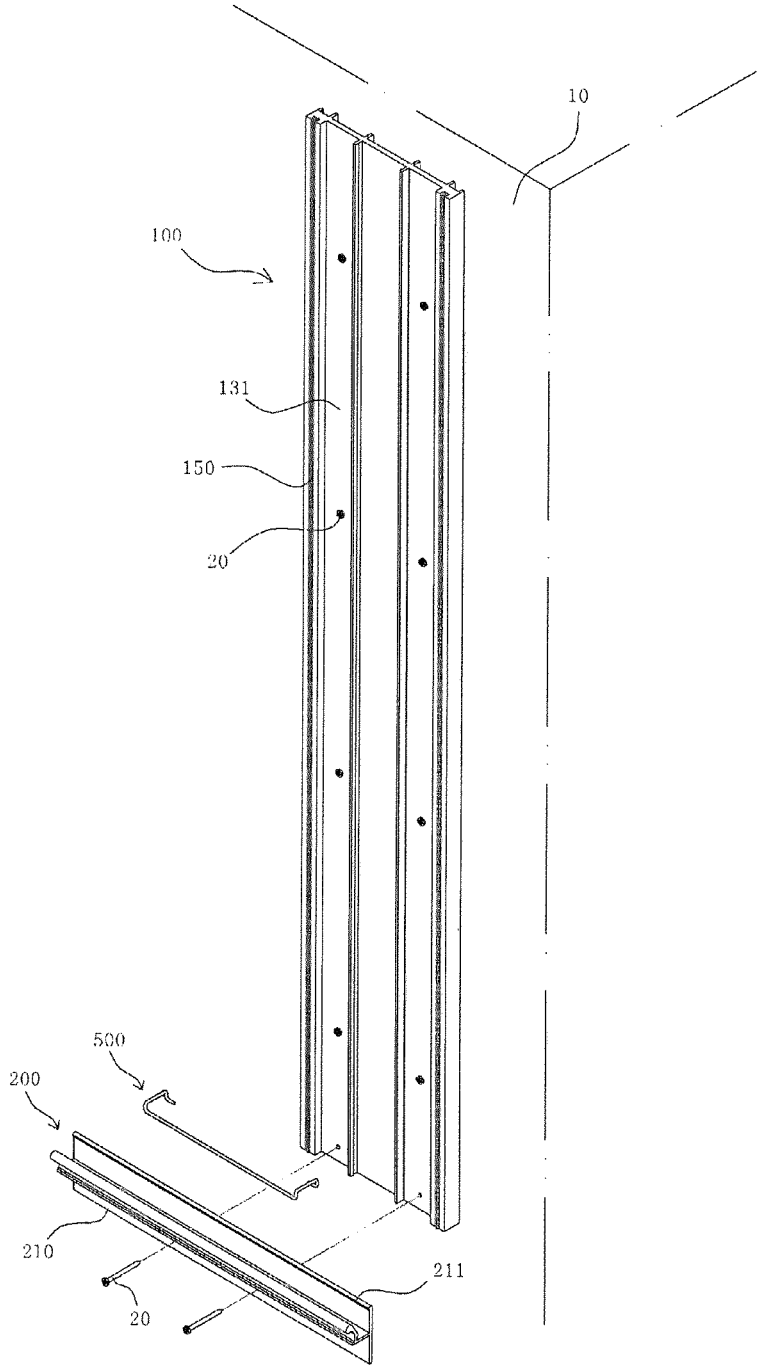
FIG. 9 is a perspective view illustrating an embodiment of a method of coupling the start panel to the panel fastening frame of the panel assembly according to the present invention.

FIG. 9 is a perspective view illustrating an embodiment of a method of coupling the start panel 200 to the panel fastening frame 100 of the panel assembly according to the present invention. Referring to FIG. 9, the start panel 200 is disposed on the lower end of the panel fastening frame 100. The start panel 200 is fastened to the panel fastening frame 100 and the wall 10 by the fastening members 20 which have been tightened into the base plate 210 of the start panel 200. The first fastening clip 500 is hooked both to the locking protrusion 211 of the start panel 200 and to the panel fastening frame 100, thus fastening the start panel 200 to the panel fastening frame 100.

Figure 10:
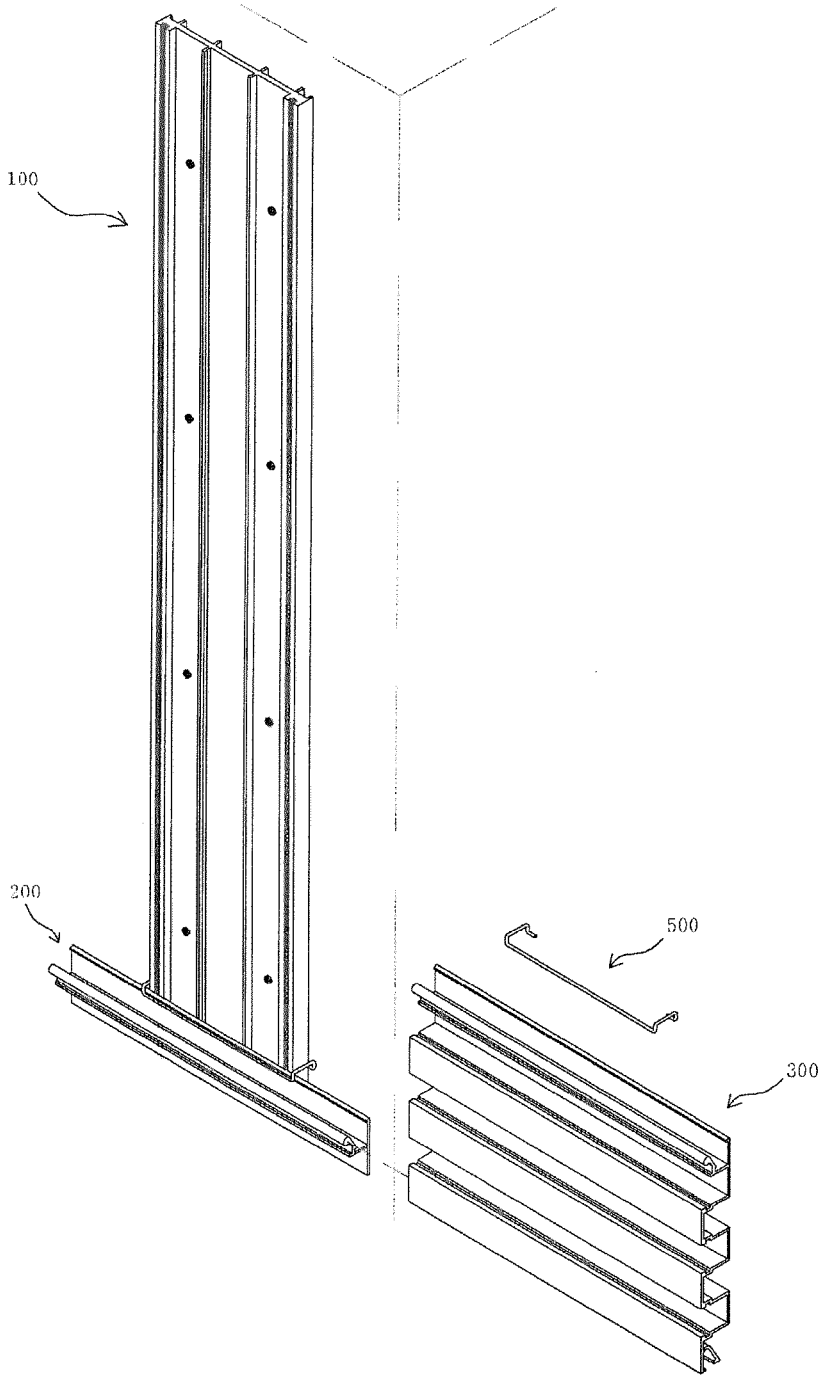
FIG. 10 is a perspective view illustrating an embodiment of a method of coupling the baseboard panel to the start panel of the panel assembly according to the present invention.

FIG. 10 is a perspective view illustrating an embodiment of a method of coupling the baseboard panel 300 to the start panel 200 of the panel assembly according to the present invention. Referring to FIG. 10, the female coupling piece 350 of the baseboard panel 300 is fitted at 45° over the male coupling piece 230 of the start panel 200 such that the coupling end 231 of the male coupling piece 230 is seated onto the seating part 352 of the female coupling piece 350, and the locking protrusion 353 of the female coupling piece 350 engages with the coupling depression 232 of the male coupling piece 230. Subsequently, the first fastening clip 500 is hooked both to the locking protrusion 311 of the baseboard panel 300 and to the panel fastening frame 100.

Figure 11:
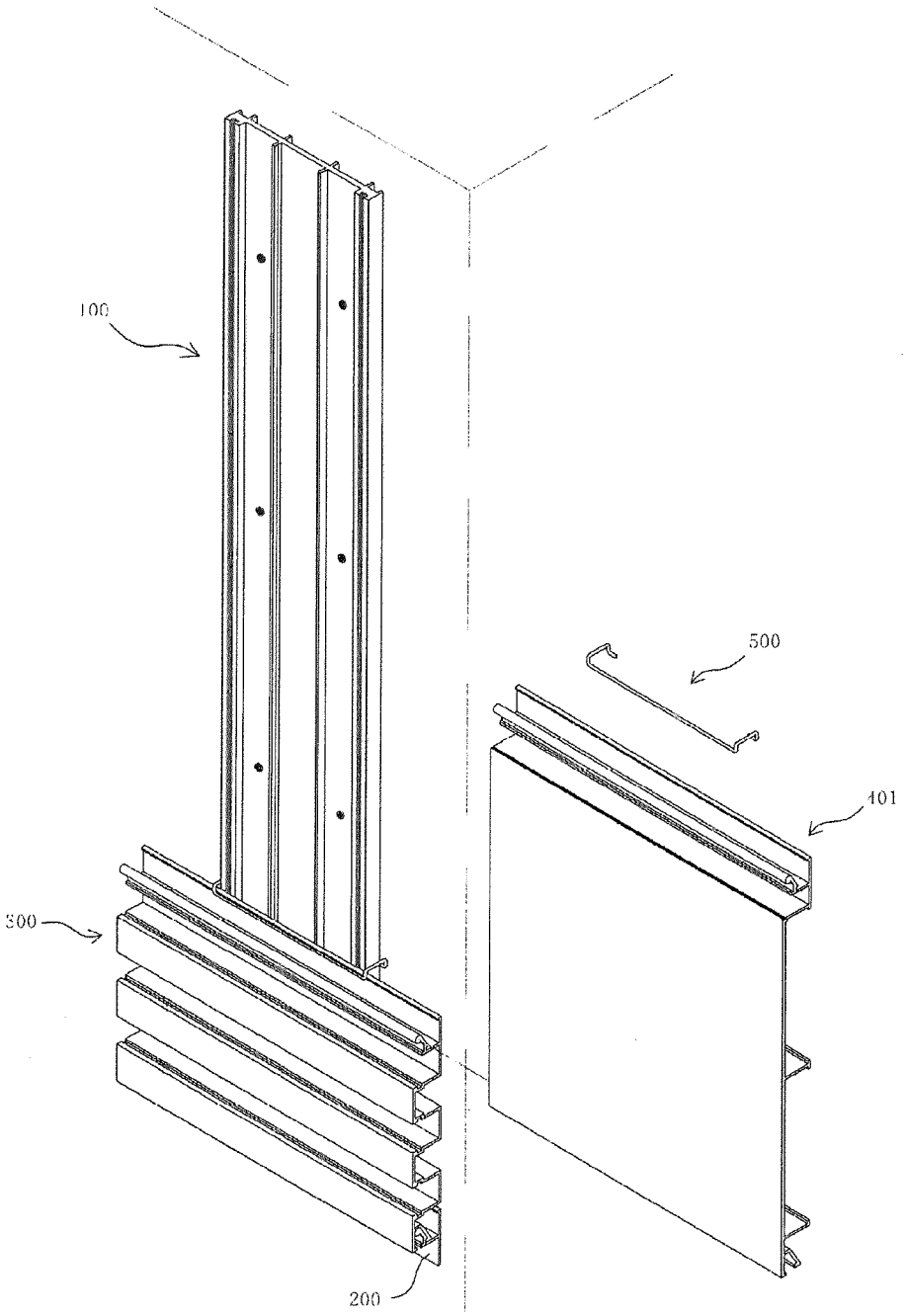
FIG. 11 is a perspective view showing an embodiment of a method of coupling the wall assembly panel to the baseboard panel of the panel assembly according to the present invention.

FIG. 11 is a perspective view showing an embodiment of a method of coupling the wall assembly panel 401 to the baseboard panel 300 of the panel assembly according to the present invention. Referring to FIG. 11, the female coupling piece 450 of the wall assembly panel 401 is fitted at 45° over the male coupling piece 330 of the baseboard panel 300 such that the coupling end 331 of the male coupling piece 330 is seated onto the seating part 452 of the female coupling piece 450, and the locking protrusion 453 of the female coupling piece 450 engages with the coupling depression 332 of the male coupling piece 330. Thereafter, the first fastening clip 500 is hooked both to the locking protrusion 411 of the wall assembly panel 401 and to the panel fastening frame 100.

Figure 12:
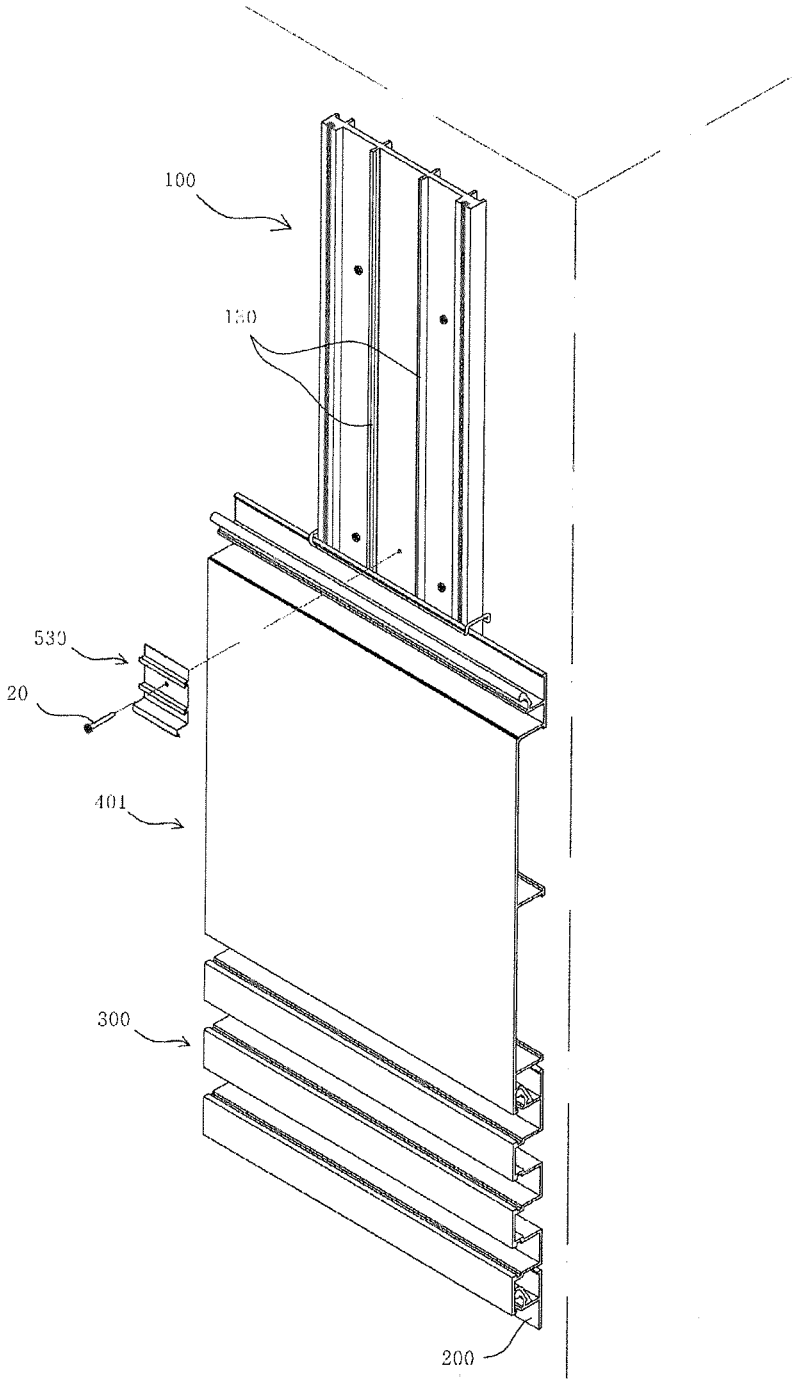
FIG. 12 is a perspective view showing an embodiment of a method of fastening the wall assembly panel to the panel fastening frame using the second fastening clip of the panel assembly according to the present invention.

FIG. 12 is a perspective view showing an embodiment of a method of fastening the wall assembly panel 401 to the panel fastening frame 100 using the second fastening clip 530 of the panel assembly according to the present invention. The second fastening clip 530 is fitted between the support ribs 130 of the panel fastening frame 100. The fastening member 20 is tightened into the through hole 533 of the second fastening clip 530 and the panel fastening frame 100 so that the wall assembly panel 401 is fastened to the panel fastening frame 100.

Subsequently, the wall assembly panel 401 is pushed by external force F toward the wall 10 such that the wall assembly panel 401 is brought into close contact with the wall 10.

Figure 13:
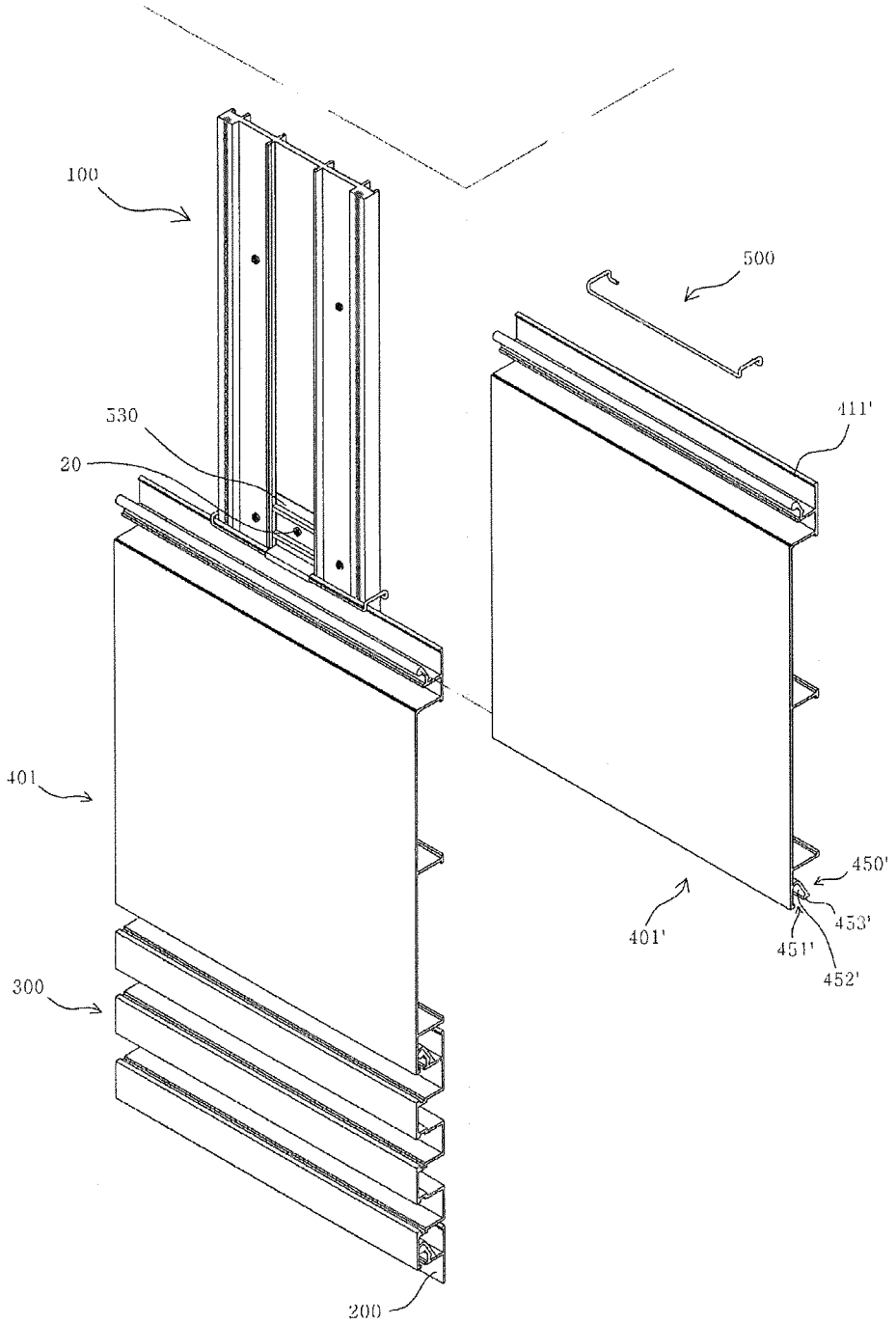
FIG. 13 is a perspective view showing an embodiment of a method of successively coupling another wall assembly panel to the wall assembly panel of the panel assembly according to the present invention.

FIG. 13 is a perspective view showing an embodiment of a method of successively coupling another wall assembly panel 401' to the wall assembly panel 401 of the panel assembly according to the present invention. Referring to FIG. 13, a female coupling piece 450' of the wall assembly panel 401' is fitted at 45° over the male coupling piece 430 of the wall assembly panel 401 so that the coupling end 431 of the male coupling piece 430 is seated onto a seating part 452' of the female coupling piece 450', and a locking protrusion 453' of the female coupling piece 450' engages with the coupling depression 432 of the male coupling piece 430. Thereafter, the first fastening clip 500 is hooked both to a locking protrusion 411' of the wall assembly panel 401' and to the panel fastening frame 100.

Subsequently, the wall assembly panel 401' is pushed by external force F toward the wall 10 such that the wall assembly panel 401' is brought into close contact with the wall 10, thus completing the construction of the panel assembly.

Figure 14:
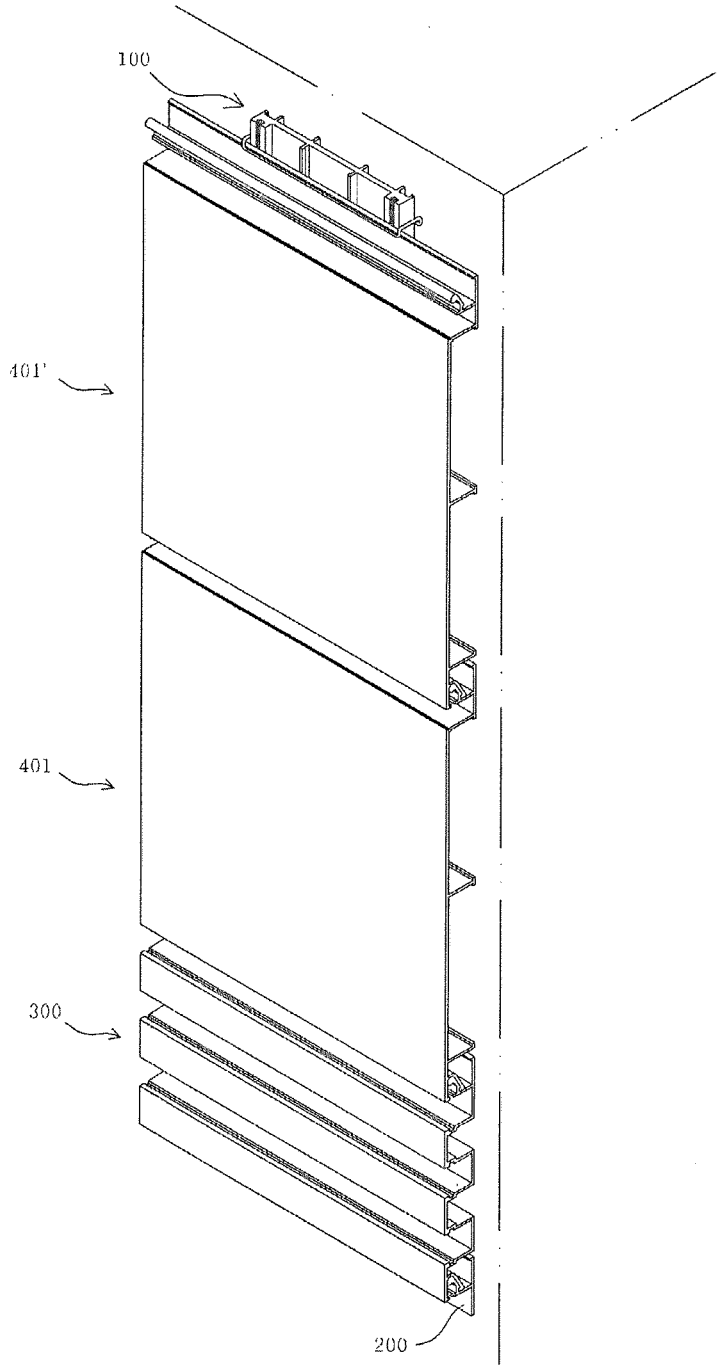
FIG. 14 is a perspective view illustrating the panel assembly that has been completely constructed according to the present invention.
Figure 15:
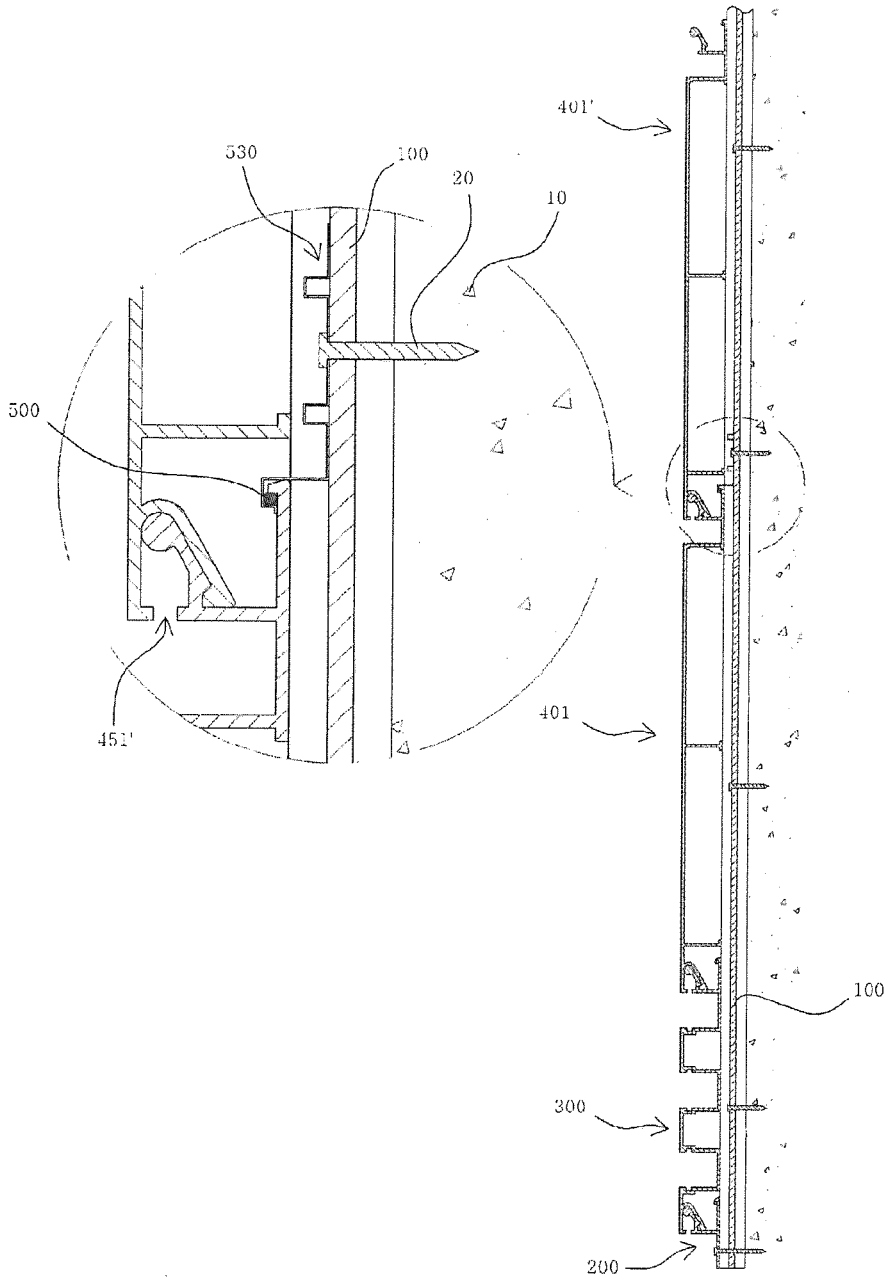
FIG. 15 is a side sectional view illustrating the panel assembly that has been completely constructed according to the present invention.

FIG. 14 is a perspective view illustrating the panel assembly that has been completely constructed according to the present invention. FIG. 15 is a side sectional view illustrating a panel assembly after it has been completely constructed according to the present invention. Referring to FIGS. 14 and 15, as described above, the method of constructing the panel assembly according to the present invention includes fastening the panel fastening frame 100 to the wall 10, fastening the start panel 200 to the panel fastening frame 100, coupling the baseboard panel 300 to the start panel 200, coupling the wall assembly panel 401 to the baseboard panel 300, and coupling another wall assembly panel 401' to the wall assembly panel 401 so that the panels can be extended in succession.

In the above-mentioned panel fastening operation, although the panel assembly has been illustrated as being constructed on the vertical wall 10, the panel assembly can also be constructed on a horizontal surface.

Alternatively, another method of constructing the panel assembly on the wall according to the present invention may include fastening the panel fastening frame 100 to the wall 10, fastening the start panel 200 to the panel fastening frame 100, coupling the baseboard panel 300 to the start panel 200, and coupling another baseboard panel to the baseboard panel 300. As a further alternative, a further construction method may include fastening the panel fastening frame 100 to the wall 10, fastening the start panel 200 to the panel fastening frame 100, coupling the wall assembly panel 401 to the start panel 200, and coupling another wall assembly panel 401' to the wall assembly panel 401.

As described above, in a panel assembly for a wall of a prefabricated building and a method of constructing the panel assembly according to the present invention, simple assembly and construction operation can make it possible to enhance the workability at a construction site, thus reducing the cost of labor. Further, the construction period can be shortened, thus reducing the cost of construction. In addition, the present invention is simple and elegant, thus satisfying the aesthetic sense of users. Moreover, the present invention is scientifically designed so that it can be precisely constructed. The functional structure of the present invention can maximize the waterproofing effect while minimizing the generation of noise. Furthermore, because the present invention uses aluminum material, the weight of the panel assembly is reduced, thus facilitating the processing operation and transportation. Also, the panel assembly reliably resists ultraviolet rays and rainwater.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A panel assembly for a wall of a prefabricated building, comprising:

a panel fastening frame comprising: a base plate; side support protrusions provided on left and right side edges of an upper surface of the base plate, with a groove formed in each of the side support protrusions; a pair of support ribs provided on the base plate between the side support protrusions and oriented parallel to each other in a longitudinal direction such that the support ribs face each other and a width therebetween is constant, each of the support ribs having a height equal to a height of the side support protrusions, with a removal prevention stopper provided on an inner surface of each of the support ribs; locking protrusions respectively provided on left and right side edges of a lower surface of the base plate; and a plurality of leg pieces provided on the lower surface of the base plate between the locking protrusions, the leg pieces having a same height, wherein the panel fastening frame is fastened to the wall by fastening members tightened into the wall after passing through depression portions formed between the side support protrusions and the support ribs;

a start panel comprising: a base plate; a locking protrusion provided on an upper surface of one side edge of the base plate; a support plate provided at a right angle on a central portion of the upper surface of the base plate; and a male coupling piece integrally provided on the support plate and oriented upward and toward the locking protrusion;

a baseboard panel comprising: an uneven plate formed of rectangular protruding portions and rectangular depressed portions which alternate with each other; a coupling panel part integrally provided on a first edge of the uneven plate, the coupling panel part having a shape equal to a shape of the start panel; and a female coupling piece provided on a second edge of the uneven plate so that the female coupling piece engages with the male coupling piece; and a wall assembly panel comprising: a planar body provided with a first leg piece and a second leg piece under a lower surface thereof; a connection piece provided on a first edge of the planar body; a coupling panel part integrally provided on the connection piece, the coupling panel part having a shape equal to the shape of the start panel; and a female coupling piece integrally provided on a second edge of the planar body; wherein the start panel is connected at a lower end of the panel fastening frame, the baseboard panel is coupled to the start panel, and the wall assembly panel is fitted over the baseboard panel.

2. The panel assembly as set forth in claim 1, wherein the male coupling piece has a coupling end provided on a first edge thereof, the coupling end having a circular cross-section, with a coupling depression formed in a lower surface of a second edge of the male coupling piece, the second edge being coupled to the support plate, and the male coupling piece is oriented upward at an angle of 30° relative to a first line perpendicular to the support plate.

3. The panel assembly as set forth in claim 1, wherein the female coupling piece comprises a coupling plate and a coupling part and has a 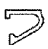 shape, wherein an opening is formed in a first side of the female coupling piece, and an arc-shaped seating part is formed in an inner surface of a second side of the female coupling piece so that the coupling end of the male coupling piece is inserted into the female coupling piece through the opening and seated onto the arc-shaped seating part, the coupling plate is coupled at a first edge thereof to the uneven plate in such a way that the coupling plate is level with upper surfaces of the protruding portions, with a shape protrusion provided on a second edge of the coupling plate so that when the female coupling piece is coupled to the male coupling piece, the shape protrusion faces the edge of the support plate to form a rectangular shape, and the coupling part comprises a connection piece oriented downwards at 60° relative to a second line extending from the coupling plate to correspond to the male coupling piece that is oriented upward at 30° relative to the first line, with a locking protrusion provided on an edge of the connection piece, the locking protrusion having a shape corresponding to the coupling depression so that the locking protrusion can engage with the coupling depression.

4. The panel assembly as set forth in claim 1, further comprising:

a first fastening clip comprising: a fastening rod in a medial portion thereof, the fastening rod being locked to the locking protrusion; and hooks provided on respective opposite ends of the fastening rod, the hooks being locked to the corresponding locking protrusions of the panel fastening frame.

5. The panel assembly as set forth in claim 1, further comprising:

a second fastening clip comprising: a pair of coupling parts, each of which has a length equal to a width between the support ribs of the panel fastening frame so that the second fastening clip can be fitted between the support ribs of the panel fastening frame, with wing pieces provided on respective opposite ends of each of the coupling parts, the wing pieces being locked to removable prevention stoppers provided in the support ribs, thus preventing the second fastening clip from being removed from the panel fastening frame; a through hole in a central portion of the second fastening clip so that a fastening member is tightened into the panel fastening frame by being passed through the through hole to fasten the second fastening clip to the panel fastening frame; and a catch part provided on one end of the second fastening clip so that the locking protrusion and the fastening rod of the first fastening clip are locked to the catch part.

6. The panel assembly as set forth in claim 1, wherein the wall assembly panel further comprises a triangular support piece provided on an end of the first leg piece.

7. The panel assembly as set forth in claim 1, further comprising:

a packing made of urethane and disposed in the groove formed in each of the side support protrusions of the panel fastening frame, the packing absorbing external shock and reducing noise generated by making contact between the panel fastening frame and the panels coupled to the panel fastening frame.

8. A method of constructing a panel assembly for a wall of a prefabricated building, comprising:

disposing a panel fastening frame on the wall and fastening the panel fastening frame to the wall using a fastening member tightened into the wall by being passed through a depressed portion of the panel fastening frame;

inserting packings into grooves formed in the panel fastening frame;

disposing a start panel on a lower end of the panel fastening frame, and fastening a base plate of the start panel to the panel fastening frame using a fastening member, and locking a first fastening clip to a locking protrusion of the start panel so that the start panel is fastened to the panel fastening frame;

fitting a female coupling piece of a baseboard panel over a male coupling piece of the start panel at an angle of 45° so that a coupling end of the male coupling piece of the start panel is seated onto a seating part of the female coupling piece of the baseboard panel, and a locking protrusion of the female coupling piece of the baseboard panel engages with a coupling depression of the male coupling piece of the start panel;

locking a second fastening clip to a locking protrusion of the baseboard panel so that the baseboard panel is fastened to the panel fastening frame;

fitting a female coupling piece of a first wall assembly panel over a male coupling piece of the baseboard panel at an angle of 45° so that a coupling end of the male coupling piece of the baseboard panel is seated onto a seating part of the female coupling piece of the first wall assembly panel, and a locking protrusion of the female coupling piece of the first wall assembly panel engages with a coupling depression of the male coupling piece of the baseboard panel;

locking a third fastening clip to a locking protrusion of the fourth wall assembly panel, and fitting a second fastening clip between support ribs provided on the panel fastening frame, and tightening a fastening member into a through hole formed in the fourth fastening clip, so that the first wall assembly panel is fastened to the panel fastening frame;

applying external force to the first wall assembly panel towards the wall so that the first wall assembly panel is brought into close contact with the wall;

fitting a female coupling piece of a second wall assembly panel over a male coupling piece of the first wall assembly panel at an angle of 45° so that a coupling end of the male coupling piece of the first wall assembly panel is seated onto a seating part of the female coupling piece of the second wall assembly panel, and a locking protrusion of the female coupling piece of the second wall assembly panel engages with a coupling depression of the male coupling piece of the first wall assembly panel;

locking a fifth fastening clip to a locking protrusion of the second wall assembly panel; and applying external force to the second wall assembly panel towards the wall so that the second wall assembly panel is brought into close contact with the wall.

* * * * *